US012680243B2

(12) United States Patent
Edelmann

(10) Patent No.: US 12,680,243 B2
(45) Date of Patent: Jul. 14, 2026

(54) METHOD FOR CONTROLLING A ROAD MILLING MACHINE AND ROAD MILLING MACHINE

(71) Applicant: BOMAG GmbH, Boppard (DE)

(72) Inventor: Ole Edelmann, Boppard (DE)

(73) Assignee: BOMAG GmbH, Boppard (DE)

( * ) Notice: Subject to any disclaimer, the term of this patent is extended or adjusted under 35 U.S.C. 154(b) by 1046 days.

(21) Appl. No.: 17/829,863

(22) Filed: Jun. 1, 2022

(65) Prior Publication Data

US 2022/0389671 A1 Dec. 8, 2022

(30) Foreign Application Priority Data

Jun. 3, 2021 (DE) ..... 10 2021 114 397.7

(51) Int. Cl.

| | |
|---|---|
| ***E01C 23/088*** | (2006.01) |
| ***E01C 23/01*** | (2006.01) |
| ***E01C 23/085*** | (2006.01) |
| ***E01C 23/12*** | (2006.01) |

(52) U.S. Cl.

CPC ..... *E01C 23/088* (2013.01); *E01C 23/01* (2013.01); *E01C 23/0855* (2013.01); *E01C 23/124* (2013.01); *E01C 23/127* (2013.01)

(58) Field of Classification Search

CPC .... E01C 23/088; E01C 23/01; E01C 23/0855; E01C 23/124; E01C 23/127

See application file for complete search history.

(56) References Cited

U.S. PATENT DOCUMENTS

| | | | | |
|---|---|---|---|---|
| 10,378,350 | B2 * | 8/2019 | Berning | E21C 35/00 |
| 2009/0016818 | A1 * | 1/2009 | Hall | E01C 23/08 404/85 |
| 2016/0356004 | A1 * | 12/2016 | Berning | E01C 23/088 |
| 2019/0024328 | A1 * | 1/2019 | Stahl | E01C 23/01 |

(Continued)

FOREIGN PATENT DOCUMENTS

| | | | |
|---|---|---|---|
| DE | 102010014695 | A1 | 10/2011 |
| DE | 102016015499 | A1 | 6/2018 |

OTHER PUBLICATIONS

Wirtgen USA Brochure_4 Selected Pages_W 200 HI (Year: 2016).*

(Continued)

*Primary Examiner* — Kito R Robinson
*Assistant Examiner* — Alexander V Gentile
(74) *Attorney, Agent, or Firm* — Wood Herron & Evans LLP

(57) ABSTRACT

A method for controlling a road milling machine for milling a ground comprising a milling drum and a rear blade when there is an obstacle located in the ground to be milled including the steps of: raising the milling drum and the rear blade out of the ground in a working direction (a) in front of the obstacle, moving over the obstacle in with the milling drum remaining out of contact with the obstacle, lowering the milling drum and the rear blade to a predetermined milling depth (FT) in the working direction (a) behind the obstacle and continuing milling of the ground, wherein raising of the milling drum is carried out before raising of the rear blade out of the ground, and wherein the road milling machine continues to move in the working direction (a) between raising of the milling drum and raising of the rear blade.

18 Claims, 7 Drawing Sheets

(56) References Cited

U.S. PATENT DOCUMENTS

| | | | | |
|---|---|---|---|---|
| 2019/0161924 | A1* | 5/2019 | Gerhardy | E01C 23/127 |
| 2022/0316156 | A1* | 10/2022 | Berning | E01C 23/127 |

OTHER PUBLICATIONS

Youtube Video (No Document Attached, Watch video at link for Understanding, posted Sep. 24, 2019 by Jay Rosa, Wirtgen W 210 Fi—Level Pro Active—Active Lift Over, Referenced from Internet <https://www.youtube.com/watch?v=3iyFM96ZZ8I> (Year: 2019).*
European Patent Office, Search Report, Applicaton No. 22177023, mailed Nov. 30, 2022 (8 pages).
German Patent Office, Search Report, Application No. 10 2021 114 397.7, mailed May 2, 2022 (5 pages).

* cited by examiner

METHOD FOR CONTROLLING A ROAD MILLING MACHINE AND ROAD MILLING MACHINE

CROSS-REFERENCE TO RELATED APPLICATION

The present application claims priority under 35 U.S.C. § 119 of German Patent Application No. 10 2021 114 397.7, filed Jun. 3, 2021, the disclosure of which is hereby incorporated herein by reference in its entirety.

FIELD OF THE INVENTION

The present invention relates to a method for controlling a road milling machine comprising a milling drum and a rear blade when there is an obstacle located in the ground to be milled. The present invention also relates to a road milling machine for performing the method.

BACKGROUND OF THE INVENTION

Generic road milling machines are used in road and path construction, for repair and renewal of roadways, squares and runways. Specifically, these are road milling machines, especially cold milling machines; for example, of the rear rotor or center rotor type. They typically comprise a machine frame supported by travel devices; for example, crawler tracks or wheels. The primary working tool of generic road milling machines is a milling drum mounted rotatably about an axis of rotation in a milling drum case. The milling drum is typically equipped with a hollow cylindrical shell, on the outer circumferential surface of which a plurality of milling tools is arranged, for example, milling picks. During operation, the milling drum is rotated about the axis of rotation so that the milling tools are driven into the ground and mill it off. How far the milling drum plunges into the ground is determined by the milling depth specified by the operator, for example. The milling depth can be achieved, for example, by adjusting the milling drum or the milling drum case relative to the machine frame. For this purpose, it is known to support the milling drum case on the machine frame by means of a lifting device that is at least partially adjustable in the vertical direction relative to the machine frame. Additionally or alternatively, the machine frame can be adjusted vertically to the ground surface together with the milling device. For this purpose, it is known to connect the machine frame to the travel devices by means of suitable lifting devices; for example, lifting columns. To contain the milled material that is thrown around, the milling drum is usually surrounded by the milling drum case, which is mounted on the machine frame, for example, and may have a front blade, two side blades and a rear blade that is adjustable in height relative to the machine frame. Furthermore, a so-called hold-down device can be provided. Like the front blade, the hold-down device is arranged in front of the milling drum transverse to the working direction and the rear blade is arranged behind the milling drum transverse to the working direction, while the side blades laterally enclose the milling drum parallel to the working direction. The control of the height adjustment of the machine frame and/or the milling drum case and/or parts thereof can be performed with the aid of a control device. The milling drum case is also used to guide the milled material onto a conveyor device, for example, a conveyor belt, from which the milled material is transferred to a transport vehicle, for example a truck, for removal. This can be done, for example, in the milling direction to the front or to the rear.

The hold-down device is typically pressed from above onto the ground to be milled, floating over it or held just above the ground in the working direction in front of the milling drum during operation of the road milling machine. It is used to prevent large clods from breaking out of the ground to be milled and to ensure that the milling drum mills off sufficiently small pieces of milled material. The front blade can have a transfer opening through which the milled material can exit the interior of the milling drum case onto the transport device. Such a transfer opening can also be provided in the rear blade. The side blades close off the side of the milling drum case, typically sliding over the ground and preventing the milled material from escaping sideways. Similar to the hold-down device, the rear blade is pressed from above onto the milled surface, also known as the milling bed, in the working direction behind the milling drum, floats above it or is held just above the milling bed. In this position, which is referred to as the working position, the rear blade shears off any protruding ground components remaining in the milling bed. On the other hand, the rear blade also scrapes off any milled material remaining in the milling bed and carries it along with the road milling machine inside the milling drum case until it reaches the conveyor device during further operation.

During milling work, there are always obstacles in the ground to be milled. These can be fixed installations; for example, manholes, manhole covers, metal plates or the like. These fixed installations should not be damaged by milling work. In addition, damage to the milling drum and the milling tools themselves, which could occur in the event of a collision with the obstacles, should also be avoided. It is therefore necessary for the operator of the road milling machine to stop it in front of each obstacle, raise the milling drum together with the milling drum case, until it has been adjusted to a vertical position above the obstacle; for example, with approximately 2 cm ground clearance, and then move over the obstacle with the milling drum out of ground contact. Behind the obstacle, the operator must stop the road milling machine again, lower the milling drum again to the desired milling depth and continue the milling process. Overall, this process therefore requires a large number of steps that the operator must carry out as precisely as possible in the workflow. An additional problem is that raising the milling drum and the milling drum case in front of the obstacle leaves a not inconsiderable amount of milled material on the milled ground in the milling bed. This leftover milled material has to be removed manually or mechanically, which increases the time required to complete the job site and thus also raises the costs. Ground not milled off by the milling drum in the working direction in front of and behind the obstacle may also have to be removed manually or by machine in a finishing work step. The effort required for this finishing work varies greatly depending on how precisely the operator raises the milling drum before the obstacle and lowers it again after the obstacle. However, this creates a tradeoff, since the operator wants to prevent a collision of the obstacle with the milling drum at all costs, while the manual finishing effort should also be kept as low as possible. As a result, the operator often tries to mill as close to the obstacle as possible and let the milling drum re-enter the ground behind the obstacle as close to the obstacle as possible. Incorrect estimations by the operator can therefore lead to damage to the obstacle and to the milling drum, or to an increased finishing effort.

Against this background, one aspect of the present invention is to increase the efficiency of the milling process when there are obstacles located in the ground to be milled. In particular, the operator of the road milling machine is to be relieved and the workload of the necessary finishing work is to be reduced.

SUMMARY OF THE INVENTION

Specifically, the aspect of the present invention described is achieved with a method for controlling a road milling machine comprising a milling drum and a rear blade when there is an obstacle located in the ground to be milled comprising the following steps:

a) Milling the ground at a predetermined milling depth along a working direction;
b) Advancing the road milling machine in the working direction towards the obstacle located in the ground;
c) Raising the milling drum and the rear blade out of the ground in the working direction in front of the obstacle;
d) Moving over the obstacle in such a way that the milling drum remains out of contact with the obstacle; and
e) Lowering the milling drum and the rear blade to the predetermined milling depth in the working direction behind the obstacle and continuing the milling of the ground.

A feature of the present invention is now that the road milling machine is controlled in such a way that in step c) the raising of the milling drum is carried out before the raising of the rear blade out of the ground, wherein the road milling machine continues to move in the working direction between the raising of the milling drum and the raising of the rear blade. In other words, the raising of the rear blade and the raising of the milling drum take place one after the other in the ongoing milling process, and the road milling machine moves at least a little further in the working direction between the raising of the rear blade and the raising of the milling drum. The rear blade is therefore not lifted out of the milling bed at the same time as the milling drum, but remains in the working position during and/or after raising of the milling drum. As a result, the rear blade is brought closer to the obstacle in its working position in the working direction than if the rear blade were raised together with the milling drum, as is the case in the prior art. The rear blade is thus only raised in the horizontal direction in relation to the path length at a point where, viewed in the milling direction, it is at the height of the area where the milling drum was previously lifted. As a result, the rear blade and the milling drum are thus adjusted relative to each other when approaching a ground obstacle to be moved over, in such a way that the milling drum is raised in the vertical direction relative to the rear blade, followed by a phase in which the rear blade is raised relative to the milling drum. In relation to the travel distance, the milling drum and the rear blade thus perform the lifting movement successively to each other and not simultaneously. In this way, the rear blade can perform its function of scraping off the milled material on the milling bed and carrying it along with the milling drum case for longer than if it had been lifted out together with the milling drum from the outset, because it is brought closer to the obstacle in its lowered position, following the lifting movement of the milling drum. Overall, this measure therefore leaves less milled material on the milling bed when the rear blade is then finally lifted out of the milling bed in front of the obstacle.

The raising of the milling drum and the raising of the rear blade each refer to a relative movement of the milling drum and the rear blade, respectively, in the vertical direction with respect to the ground or a virtual ground reference plane. The milling drum can, for example, be designed to be height-adjustable within the milling drum case relative to the milling drum case. In this case, the milling drum can be raised independently of the rear blade and the rear blade can remain in the working position without having to be adjusted for this purpose. However, it is also possible for the milling drum to be designed to be height-adjustable together with the entire milling drum case. In this case, the entire milling drum case, including the rear blade, is also raised when the milling drum is raised. It may therefore be necessary for the rear blade to be extended downwards during the raising of the milling drum to compensate for a vertical adjustment of the entire milling drum case relative to the rest of the milling drum case in order to remain in the working position. In other words, the extension movement of the rear blade during the raising of the remaining milling drum case is ideally performed in such a way that the lifting movement of the remaining milling drum case in the vertical direction is compensated. As an approximation, the lifting adjustment of the rear blade is thus preferably controlled in such a way that it maintains its vertical position in relation to the ground surface during the raising of the remaining milling drum case. The rear blade is adjusted relative to the milling drum and relative to the machine frame, but ideally remains in the same relative position to the ground, i.e., the working position. It is therefore not a case of "raising" the rear blade according to the present invention.

Due to the rotation of the milling drum in operation, cutting circles are defined by the milling tools, in particular by the milling pick tips. The cutting circles describe the paths along which the milling pick tips, for example, move together with the milling drum about the axis of rotation. The cutting circles thus determine how much ground is removed by the milling drum at a specific vertical height, or the final milling depth. When the diameter of the milling drum is referred to here, this means in particular the diameter of the largest cutting circle. Ground is removed from the milling drum along this cutting circle during operation. Raising the milling drum out of the ground therefore leaves an excavation area in which the milling depth of the milled track begins to decrease as the milling drum is raised in the working direction. In the excavation area, there is typically a ramp or transition area from the milling bed lying at the predetermined milling depth to the unmilled ground, wherein the transition area may be substantially a negative of the milling drum circumferential section or cutting circle segments of the milling drum; for example, when the milling drum is raised with the machine at a standstill. The formation of this ramp is due to the geometry of the milling drum and the cutting circles. There is a front edge at the deepest point of the excavation or milling area. The deepest point of the excavation area is the point directly vertically below the axis of rotation of the milling drum at the position where the milling drum is raised. This front edge has the distance from the height of the unmilled ground surface corresponding to the previous milling depth. The front edge of the excavation area is therefore created at the position where the milling drum is still milling the ground to the full specified milling depth before it is raised. It therefore describes the transition from the ground milled to the full specified milling depth or the milled bed ground to the ramp of the excavation area.

According to one embodiment of the present invention, the rear blade is to be raised closer to the leading edge of the excavation area in the working direction than in the prior art. The later the rear blade is raised, the more milled material is still carried by it in the working direction and the less milled material is left on the milling bed after it is raised. It is therefore preferable according to one embodiment for the rear blade to be raised as close as possible and, in particular, only immediately at the front edge of the excavation area. The position in the working direction at which the rear blade is moved vertically upwards from its working position or away from the bottom of the milling bed and thus raised is referred to as the displacement point. According to one embodiment of the present invention, it is therefore provided that the raising of the rear blade takes place at a displacement point along the working direction, which has a distance to the front edge of the excavation area that is smaller than a distance of the rear blade to the axis of rotation of the milling drum. In the prior art, on the other hand, the milling drum and the rear blade are typically raised at the same time, so that the distance from the displacement point of the prior art to the front edge of the excavation area is equal to the distance from the rear blade to the axis of rotation of the milling drum. The distances mentioned always refer to the working direction. The distance between the said displacement point and the front edge of the excavation area according to one embodiment of the present invention corresponds in particular to a maximum of 75%, preferably a maximum of 50% and particularly preferably a maximum of 25%, of the distance of the rear blade from the axis of rotation of the milling drum in the working direction. An alternative of the present invention provides that the raising of the rear blade takes place at a displacement point along the working direction, which is located on, in particular directly on, the front edge. The rear blade is raised out of the milling track at the same position in the working direction as the milling drum. As described above, the ramp begins behind the front edge of the excavation area in the working direction, i.e., the depth of the milled track decreases. At this point at the latest, the rear blade must therefore be raised, otherwise it could collide with the ramp and be damaged. At the same time, carrying the rear blade in the working position up to the front edge of the excavation area leaves as little milled material as possible on the milling bed up to the front edge.

Compared to the prior art, the longer carrying the rear blade in the working position is advantageous in terms of the smaller quantity of milled material left behind in the milling bed. Advantageously, however, in a further development, the present invention according to one embodiment also provides for controlling the manner in which the rear blade is raised so that the rear blade traverses a predetermined movement path, hereinafter also referred to as a trajectory. The lower edge of the rear blade facing the ground is used as the reference point for the movement path. The movement path or trajectory of the rear blade is created by superimposing all the movements performed by the rear blade; for example, a height adjustment in the vertical direction of the rear blade itself and the travel movement of the road milling machine in the working direction. The road milling machine may also accelerate or brake. Both the travel speed and, in particular, an acceleration of the road milling machine are detected by sensors on the machine, so that these are available and also used for the control according to the present invention of the rear blade along the trajectory. Overall, it is therefore preferred according to one embodiment that the raising of the rear blade is controlled in such a way that a lower edge of the rear blade facing the ground follows a predetermined trajectory during the raising, taking into account the advancement speed and in particular the acceleration of the road milling machine. The trajectory starts when the rear blade is in the working position at the displacement point. It therefore begins immediately on or slightly above the milling bed at the displacement point where the raising of the rear blade begins. The trajectory ends in a raised position of the rear blade, in which the rear blade has been raised by at least the specified milling depth. In this raised position, the rear blade can therefore be guided over the obstacle in the working direction without damaging it or being damaged itself. The trajectory also comprises a movement of the rear blade in the working direction and therefore ends in the working direction behind the excavation area, i.e., in the area of the unmilled ground or obstacle. The rear blade can float over the obstacle, in particular without pressure, i.e., without being subjected to a contact force in the vertical direction downwards towards the obstacle. In this case, the rear blade makes contact with the obstacle, but slides along it without damage. Alternatively, the rear blade can be adjusted with a vertical safety distance, for example 2 cm, beyond the obstacle so that the rear blade can be guided over the obstacle without contact or floating.

Between the start and end points of the trajectory described above, the trajectory may take different forms. For example, the trajectory exclusively comprises a movement transverse to the working direction vertically upwards and a subsequent movement horizontally in the working direction. In this embodiment, it is thus provided that the rear blade is adjusted in a single vertical movement between the working position and the raised position. In particular, it can be provided that the movement transverse to the working direction vertically upwards is not superimposed on a travel movement of the road milling machine in the working direction. The road milling machine is thus stopped for the adjustment of the rear blade and does not move in the working direction, while the rear blade is adjusted vertically upwards from the working position to the raised position. Only then does a new movement of the road milling machine and thus also of the rear blade in the working direction follow. In other words, the trajectory has the form of a single, in particular rectangular, step. However, the trajectory can also have the form of a plurality of, in particular rectangular, steps. For example, the trajectory comprises a plurality of step-wise movements transverse to the working direction vertically upwards, wherein the lower edge of the rear blade moves horizontally in the working direction between the steps. The horizontal movement in the working direction is achieved by the advancement of the road milling machine. As already described for the single-step trajectory, it can also be provided here that the step-wise vertical movements are not superimposed with a travel movement of the road milling machine in the working direction. Here, this also means that the road milling machine is stopped during the vertical adjustment of the rear blade and does not move in the working direction. The multi-step design of the trajectory keeps the rear blade and, in particular, the lower edge of the rear blade closer to the ramp of the excavation area overall than, for example, the single-step trajectory. The more steps are provided, the more successful this is. It is therefore preferred according to one embodiment that the trajectory comprises at least two, preferably at least three, particularly preferably at least four, and most preferably at least five steps. This allows the milled material carried along by the rear blade to be at least partially carried further up the ramp in the excavation area and not to be left completely in the milling bed, where it would require time-consuming finishing work.

In order to make the movement sequence during the raising of the rear blade more fluid and, at the same time, to keep the rear blade or the lower edge of the rear blade even closer to the surface of the ramp of the excavation area, it is particularly preferred that the trajectory comprises at least one inclined movement, simultaneously transverse to the working direction vertically upwards and horizontally in the working direction. In other words, the adjustment of the rear blade in the vertical direction is superimposed with a forwards travel of the road milling machine in the working direction. Overall, this results in an at least partially inclined trajectory, in particular directed inclined forwards and upwards. It is particularly preferred that the road milling machine moves in the working direction throughout the raising of the rear blade. The road milling machine is therefore not stopped during the raising and continues to travel in the working direction, resulting in a particularly fluid workflow. The inclined movement can be used for both single-step and multi-step trajectories. As a result, the steps of the trajectory are no longer right-angled but have an obtuse angle. In the multi-step design of the trajectory, in which the lifting of the rear blade from the working position to the raised position is divided into a plurality of separate movements, it is possible that all of these separate movements are inclined. In other words, it is possible that any movement of the rear blade in the vertical direction away from the milling bed ground is superimposed on a forwards movement of the road milling machine.

According to one embodiment of the present invention, it is provided that the trajectory follows a ramp created by the raising of the milling drum in the excavation area in such a way that the lower edge of the rear blade substantially abuts the surface of the ramp over the entire excavation area. This embodiment requires particularly precise control of the vertical position of the rear blade and the advancement speed of the road milling machine, in particular including its acceleration. These values for the movement of the rear blade and the road milling machine are therefore recorded by a control device. In addition, it is advantageous to know the geometry of the milling drum and in particular its diameter or the diameter of the cutting circles since this determines the shape of the ramp. The geometry of the milling drum is known in advance and is stored in the control device and/or can be entered at the control device. All parameters are therefore known and are used by the control device to adjust the rear blade or are taken into account during adjustment so that the rear blade follows the trajectory. In this case, the lower edge of the rear blade can, for example, be subjected to a force directed vertically downwards onto the ground, as is usual in operation, so that the lower edge of the rear blade scrapes the surface of the ramp. At the same time, the height position of the rear blade must be adjusted according to the ramp geometry so that the rear blade can actually follow the shape of the ramp and does not get stuck on it. Alternatively, it can be provided that the rear blade can be guided up the ramp in a sliding or floating manner without being pressed onto the ground. The rear blade is therefore in contact with the surface of the ramp, but is not actively subjected to a force directed towards the ground. The trajectory follows the surface of the ramp. Finally, it is also possible to control the lower edge of the rear blade along a trajectory that corresponds to the shape of the ramp, but to distance the lower edge from the ramp by a safety distance, for example 2 cm. The lower edge of the rear blade is therefore floated along the ramp. The above embodiments all describe options in which the lower edge of the rear blade substantially abuts the surface of the ramp throughout the excavation area. In particular, the lower edge of the rear blade, and thus the rear blade itself, is adjusted particularly close along the ramp between the working position and the raised position. In this way, a large proportion of the loose milled material in the milling drum case is transported up the ramp by the rear blade and does not remain in the milling bed. This results in significant time savings, as rework is no longer necessary.

In principle, the method according to one embodiment of the present invention can be carried out manually by an operator in a step-wise manner by controlling the road milling machine accordingly. However, in order to relieve the operator as far as possible, it is preferred that at least step c), and in particular also steps d) and e), are carried out automatically, in particular triggered by a single control command from an operator. The milling of the ground in normal operation according to step a) and the approach of the road milling machine to the obstacle according to step b) are thus carried out or controlled by the operator as usual. To use the method according to one embodiment of the present invention, the operator then positions the road milling machine as close as possible to the obstacle. However, instead of then controlling the raising of the milling drum, the operator simply enters a control command on the road milling machine's control device; for example, via a control element such as a switch or a touchscreen. The lifting of the milling drum according to step c) is then carried out automatically by the control device of the road milling machine, wherein the rear blade and in particular the lower edge of the rear blade are guided in particular along the predetermined trajectory. Once the raising is completed, the operator can again control the moving over of the obstacle according to step d) and position the road milling machine behind the obstacle. By means of a further control command from the operator, the lowering according to step e) is then possibly carried out again automatically by the control device, wherein here in particular the working parameters which were already present before the lifting according to c) are set again. In this way, the work operation can be continued quickly and easily.

The operator can additionally enter an extension of the obstacle in the working direction in advance; for example, at the control device. If the extension of the obstacle in the working direction is entered by the operator in advance, all steps c), d) and e) triggered by a single control command from the operator can be carried out automatically, in particular by the control device. As described above, the operator thus positions the road milling machine as close as possible to the obstacle. Then the operator only gives the control command to the control device, whereupon it automatically carries out the raising of the milling drum according to step c), the moving over of the obstacle according to step d) and the lowering of the milling drum and the rear blade according to step e), without the operator having to take any further action. The operator therefore only carries out normal milling work up to just before the obstacle, then gives the control command, whereupon the road milling machine automatically mills around the obstacle, and can then continue the milling work in the working direction behind the obstacle as normal. In this way, not only is finishing work minimized, but the operator of the road milling machine is also relieved during working operation.

As described above, the method according to one embodiment of the present invention can be carried out by the operator of the road milling machine detecting the obstacle located in the ground to be milled and determining or specifying its extension in the working direction as a basis for automatic control. However, the detection of the obstacle itself and also of its dimensions, in particular its extension in the working direction, can alternatively also be carried out by a sensor device. For this purpose, it is possible that at least one sensor device is arranged in front of the milling drum in the working direction, which is designed to detect obstacles in the ground to be milled. For this purpose, the sensor device may comprise, for example, an inductive, capacitive or magnetic sensor, such as a metal detector. Additionally or alternatively, the sensor device may also comprise an optical sensor; for example, a camera or a thermal imaging camera, or a sound sensor; for example, an ultrasonic sensor. It is important that the sensor device is able to detect obstacles that are within the milling width of the road milling machine or milling drum. The detection range of the sensor device must therefore cover the entire milling width of the milling drum so that laterally offset obstacles can also be reliably detected. In order to achieve this, the sensor device can also have a plurality of sensors; for example, a plurality of sensors of different types, distributed transversely to the working direction, for example.

If the road milling machine has a sensor device which can detect an obstacle located in the ground to be milled, it is possible that step c), and in particular also steps d) and e), are carried out automatically, triggered by the detection of an obstacle by the sensor device. In particular, in order to carry out steps c), d) and e), the extension of the obstacle in the working direction is determined by the sensor device. The sensor device thus automatically detects a front edge of the obstacle in the working direction and a rear edge of the obstacle in the working direction and determines the extension of the obstacle in the working direction between these two edges. Thereupon, the raising of the milling drum according to step c), the moving over of the obstacle according to step d) and the lowering of the milling drum and the rear blade according to step e) are carried out without the operator having to take any further action. In particular, it is no longer even necessary for the operator to issue a control command that triggers these steps. This is also possibly carried out automatically by the control device on the basis of the detection of the obstacle.

In order to increase the flexibility and, if necessary, the safety of the method according to the present invention, it can also be provided that the sensor device detects the presence and, in particular, the dimensions of the obstacle, but that the operator nevertheless gives specific instructions for controlling, in particular, the raising according to step c) and moving over according to step d) and/or the lowering according to step e). In particular, the operator should be able to specify how much unmilled ground should be left around the obstacle. For this purpose, it is provided that the operator is shown a representation of the obstacle on a display device produced from data obtained from the sensor device, and in that the operator can specify on the display device the front and rear edges of the obstacle in the working direction, wherein steps c), d) and e) are then carried out in such a way that the milling drum remains out of contact with the edges of the obstacle specified by the operator. For example, the operator may be shown the image from a camera on the display device with the obstacle visible on the image. The operator can then use input elements, such as a touchscreen, to define the front and back edges of the obstacle in the working direction based on the image. These dimensions of the obstacle in the working direction, determined by the operator, are then used as the basis for further control. The control is such that the milling drum is raised out of the ground in front of the front edge of the obstacle in the working direction and is only lowered back into the ground behind the rear edge of the obstacle in the working direction. Potentially damaging contact between the milling drum and the obstacle is avoided.

According to one embodiment of the present invention, advancing the road milling machine in the working direction towards the obstacle located in the ground according to step b) is also carried out automatically by the control device. For this purpose, the control device can position the road milling machine as close as possible to the obstacle. On the one hand, the milling drum should be raised as close as possible to the obstacle in order to minimize protruding residues of the ground to be milled off, which have to be removed manually or mechanically afterwards. On the other hand, it should be ensured that neither the obstacle nor the milling drum are damaged by a collision. Due to the geometry of the milling drum, it should be noted that the road milling machine can approach obstacles from different distances depending on the milling depth. Due to the circular diameter of the milling drum, it must be raised earlier at high milling depths and can be raised later at lower milling depths to keep it out of contact with the obstacle. It is therefore provided that the position in the working direction at which the raising of the milling drum is carried out is determined taking into account the position of the obstacle, the milling depth and in particular also the geometry of the milling drum in order to keep it out of contact with the obstacle. In particular, this position is determined automatically by the control device, so that step b) of advancing the road milling machine in the working direction towards the obstacle located in the ground is also carried out automatically by the control device and without any intervention by the operator. In this case, the operator can fully concentrate on milling the ground according to step a). All further steps b) to e), which deal with the avoidance due to the obstacle, are possibly carried out automatically by the control device.

Since the road milling machine removes little to no milled material from the ground during steps c) and d), it is possibly provided that when these steps are carried out, a conveyor device of the road milling machine is put out of operation, in particular automatically. This can also be performed by the control device. In this way, additional attention does not have to be paid to the error-free and low-loss transfer of the milled material to a transport vehicle while these steps are being carried out. Corresponding sources of error are thus reduced and work safety increased. In addition, the conveyor device is possibly automatically reactivated in step e) in order to continue the milling process smoothly.

In order to ensure a simple, fast and seamless transition of the milling operations before the obstacle and after the obstacle, it is possibly provided that for continuing the milling of the ground according to step e) the same machine settings, in particular with regard to milling depth and/or advancement speed and/or operation of the conveyor device, are automatically set, in particular as they were in step a). The milling work should therefore be continued in the working direction behind the obstacle with the same machine settings that were set before the obstacle. Accordingly, the respective settings are stored by the control device and automatically restored in step e).

In order to leave as little milled material as possible on the obstacle as well, it is possibly provided that the rear blade, while moving over the obstacle according to step d), is kept in the raised positions either resting against the unmilled ground and the obstacle or floating above it with a safety distance, for example 2 cm. In this way, a large proportion of the milled material is transported out of the obstacle in the milling bed located in front of the obstacle in the working direction, then conveyed over the obstacle by the rear blade and retained in the milling drum case until the milling drum is lowered again. As soon as the milling work starts again in the working direction behind the obstacle, the milled material can then be transported to the conveyor device and disposed of as normal. The milling drum can again be positioned behind the obstacle in the working direction in exactly the same way as at the start of a new milling track. However, in order to leave as clean a milling bed as possible at the start of the new milling track in the working direction behind the obstacle, it may be preferable to control the lowering of the rear blade to the specified milled depth in the working direction behind the obstacle in such a way that the lower edge of the rear blade follows one of the trajectories described above in the reverse direction during lowering. In principle, this can be any of the trajectories described above. In particular, it is the same trajectory as during the excavation. The control of the lowering of the rear blade and the advancement speed of the road milling machine is therefore carried out in such a way that the corresponding trajectory is traversed in exactly the opposite direction. In this way, as little milled material as possible remains both in front of and behind the obstacle, which has to be removed during time-consuming finishing work.

The method can be further improved by storing obstacle widths during the method. In this case, the width of the obstacle refers to the extension of the obstacle in the travel or milling direction of the road milling machine. This can be useful, for example, for obstacles that have to be crossed several times and/or obstacles with standard widths, such as manhole covers, etc. In this case, the operator can, for example, signal the reaching of such an obstacle with a stored width with manual triggering. This determines the distance over which the milling drum and the rear blade are to be raised according to the above specifications. In particular, it also eliminates the need for the driver to trigger lowering as well. Additionally or alternatively, an offset can also be provided. This designates a distance, in particular which can also be defined manually, in front of and behind the obstacle in the milling direction. This can be defined individually for each obstacle by the operator or can be stored as a defined value in a memory device.

The above-mentioned aspect of the present invention is also achieved with a road milling machine for milling a ground in a working direction. The road milling machine according to the present invention comprises a milling drum case which is height-adjustable relative to the ground. This height adjustment can be achieved by means of an adjustment device designed in such a way that the milling drum case can be fully or partially adjusted in height relative to the machine frame. Additionally or alternatively, the machine frame can be connected to the travel devices running on the ground by means of vertically adjustable lifting devices. In this case, the milling drum case is thus adjusted in the vertical direction together with the machine frame. The milling drum case can have a front blade, a hold-down device, two side blades (one each on the front side of the milling drum) and a rear blade which can be adjusted in height relative to the machine frame. In addition, it comprises a milling drum rotatably mounted about an axis of rotation in the milling drum case, in particular horizontal and transverse to the working direction, and a control device. The road milling machine according to one embodiment of the present invention is characterized in that the control device is designed to carry out the method described above. All the features, effects and advantages mentioned above for the method therefore also apply in a figurative sense to the road milling machine according to the present invention and vice versa. Reference is made to the other respective statements merely to avoid repetition.

As described at the outset, the milling drum can either be designed to be height-adjustable within the milling drum case and relative thereto, or the milling case is designed to be height-adjustable together with the milling drum case. Depending on how the milling drum of the road milling machine is height-adjustable, it may be advantageous for the rear blade, and in particular the lower edge of the rear blade, to be designed to be lowered lower than the milling drum and in particular its lower apex. The lower apex of the milling drum is related to the largest cutting circles of the milling drum. In other words, it is possibly provided that the road milling machine has an adjusting device for adjusting the height of the rear blade, which is designed in such a way that the rear blade can be adjusted to below the lower apex of the milling drum, in particular by at least 10%, preferably by at least 20%, particularly preferably by at least 30%, of the diameter of the milling drum. This ensures in particular that the rear blade can still be in the working position while the milling drum is or has already been raised, even if the milling drum is always adjusted in height together with the entire milling drum case. In this case, the rear blade performs a counter-movement for compensation, during which the rear blade is moved vertically below the milling drum and, in particular, also below its lower apex.

BRIEF DESCRIPTION OF THE DRAWINGS

In the following, the present invention will be described in more detail using the exemplary embodiments shown in the figures. The figures schematically show the following.

Identical or identically acting components are designated with the same reference numerals. Repeated components are not designated separately in each figure.

DETAILED DESCRIPTION OF THE INVENTION

Figure 1:
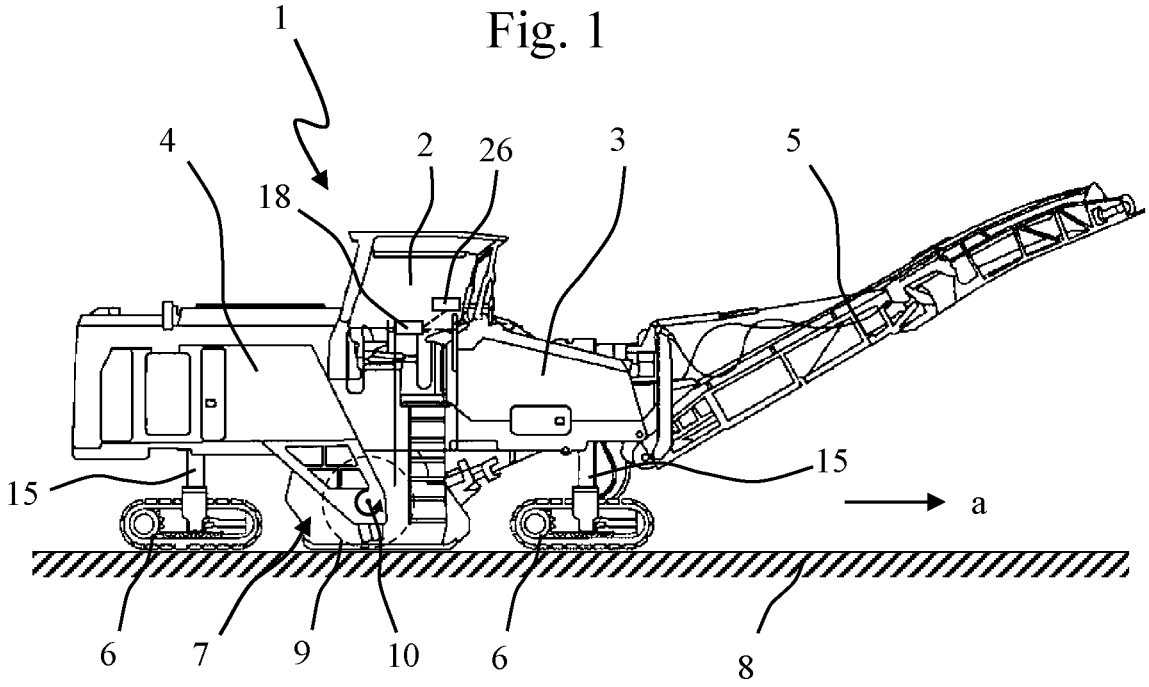
FIG. 1 shows a side view of a road milling machine.

FIG. 1 shows a road milling machine 1—here a road milling machine or cold milling machine of the center rotor type—for milling a ground 8 in a working direction a. The road milling machine 1 has a machine frame 3 and a driver's cab 2. The machine frame 3 is supported by lifting columns 15, which connect the machine frame 3 to the travel devices 6, which in the exemplary embodiments shown are designed as crawler tracks, although they may also be wheels. The machine frame 3 can be adjusted in height or in the vertical direction relative to the ground 8 by means of the lifting columns 15. The road milling machine 1 further comprises a drive motor 4, which is typically a diesel internal combustion engine, although it may also be an electric motor, for example. A hybrid drive is also possible. As a primary working unit, the road milling machine 1 has a milling drum 9 which is mounted rotatably about an axis of rotation 10 in a milling drum case 7. During operation of the road milling machine 1, the milling drum 9 rotates about the axis of rotation 10, milling ground material from the ground 8. This milled off material is transferred from the milling drum case 7 to a conveyor device 5, which typically comprises a conveyor belt, and which is designed to transfer the milled material to a transport vehicle (not shown) for removal. The milling drum case 7 can be arranged stationary on the machine frame 3 in the vertical direction. Alternatively, an adjustment device can be provided which is designed in such a way that the milling drum case can be adjusted in the vertical direction relative to the machine frame. In this case, the lifting devices 15 could also be dispensed with. In the driver's cab 2, in the embodiment shown, there is a control device 18, which is part of the on-board computer of the road milling machine 1, for example. In particular, the control device 18 is provided with input means, by means of which an operator can input control commands to the control device 18 to control the road milling machine 1. Furthermore, the control device 18 is connected to a display device 26; for example, a display. The display device 26 can also simultaneously be designed as an input means; for example, as a touchscreen.

Figure 2:
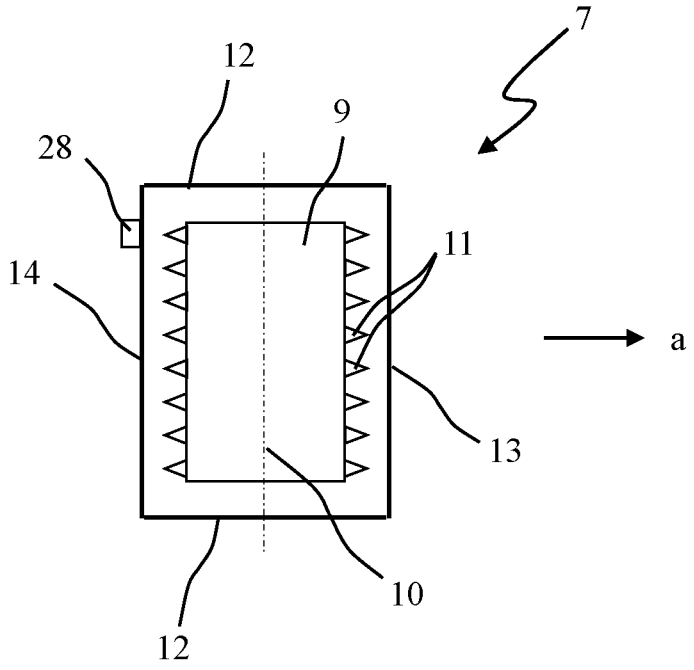
FIG. 2 shows a top view of a milling drum case and a milling drum.

FIG. 2 shows a top view of a milling drum 9 arranged in the milling drum case 7. For the sake of clarity, a vertical closure at the top or a cover is not shown in FIG. 2. The milling drum 9 has a multiplicity of milling tools 11; for example, milling picks. The milling tools 11 are thus arranged distributed over the outer shell of the hollow cylindrical milling drum 9; for example, in spirals. Overall, the milling drum case 7 surrounds the milling drum 9 like a hood and is substantially only open in the direction to the ground 8, i.e., downwards (a material passage opening can also be provided in the front and/or rear blade). In the working direction a at the front, the milling drum case 7 is closed by a front blade 13. The front blade 13 may comprise a hold-down device. The hold-down device can also be arranged as a separate element in front of the front blade 13 in the working direction a. In particular, when the milling drum 9 rotates in the reverse direction of rotation with respect to the travel devices 6, the hold-down device pressing on the ground 8 in front of the milling drum 9 prevents larger clods from breaking out of the ground 8. Laterally, the milling drum case 7 is bounded by side blades 12, which are slid along on the ground 8 next to the milling drum 9 and prevent milled material from escaping laterally from the milling drum case 7. In the working direction a at the rear, the milling drum case 7 is closed by a rear blade 14. The rear blade 14 scrapes off the milled material lying on the ground 8 and ensures that this is transported along with the milling drum case 7 and channeled away from it. In this way, the milling bed is left as clean as possible. In principle, the front blade 13, the side blades 12 and the rear blade 14 can each be designed to be height-adjustable. For the sake of clarity, only one adjustment device 28 for adjusting the height of the rear blade 14 is shown. This comprises, for example, one or a plurality of, in particular double-acting, hydraulic cylinders. By means of the adjusting device 28, the rear blade 14 is designed to be height-adjustable, in particular relative to the machine frame 3 and/or to the milling drum 9 and/or to the ground 8.

Figure 3:
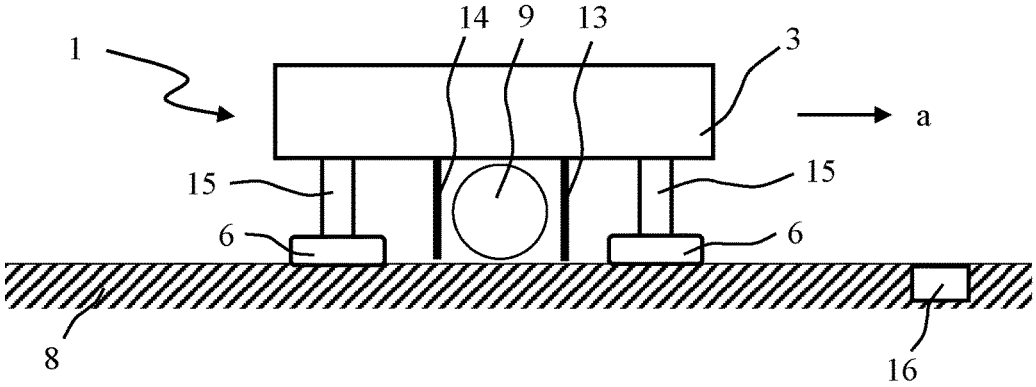
FIGS. 3-9 show a time sequence of milling operations with an obstacle located in the ground to be milled.
Figure 4:
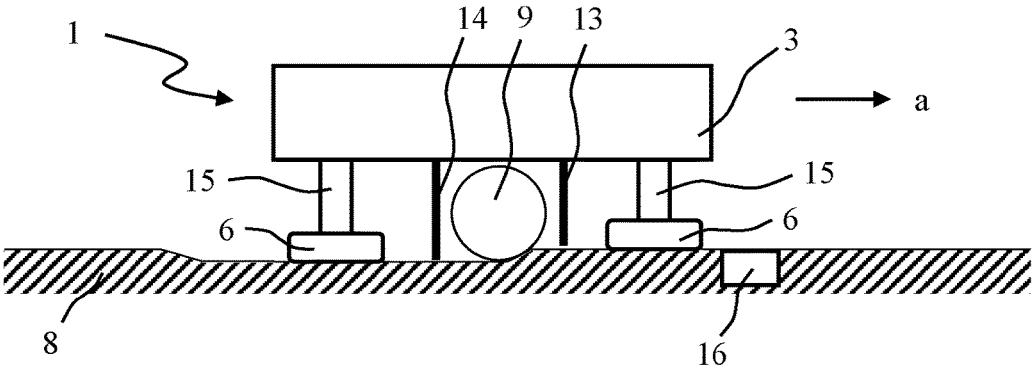
Figure 5:
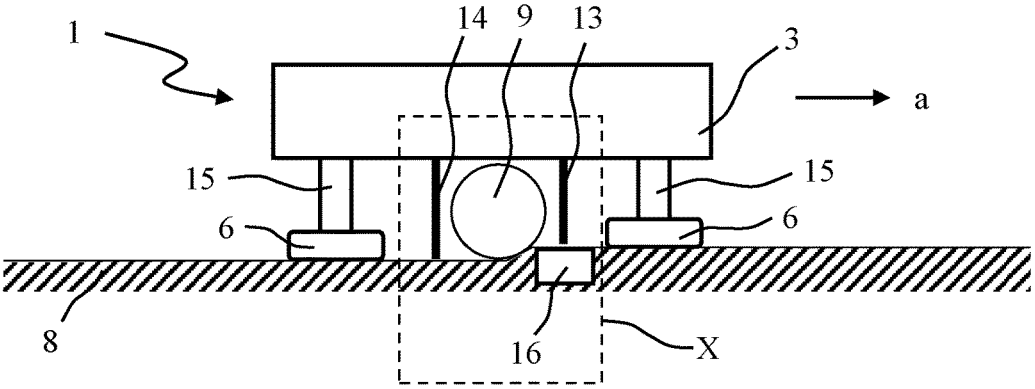
Figure 6:
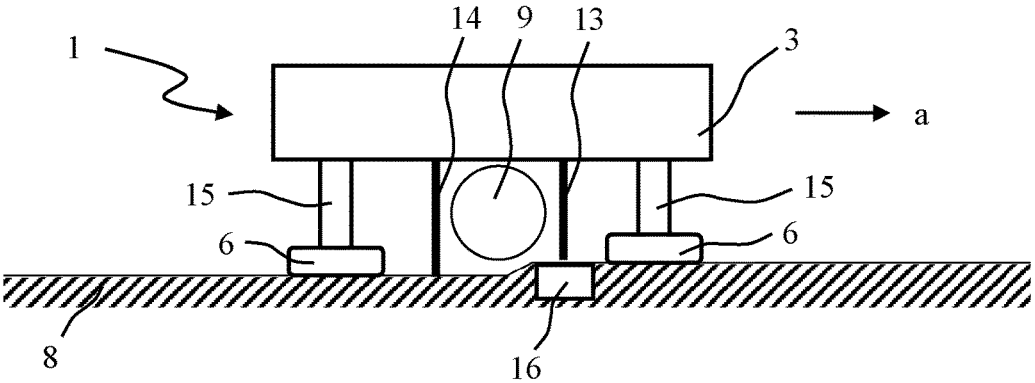
Figure 7:
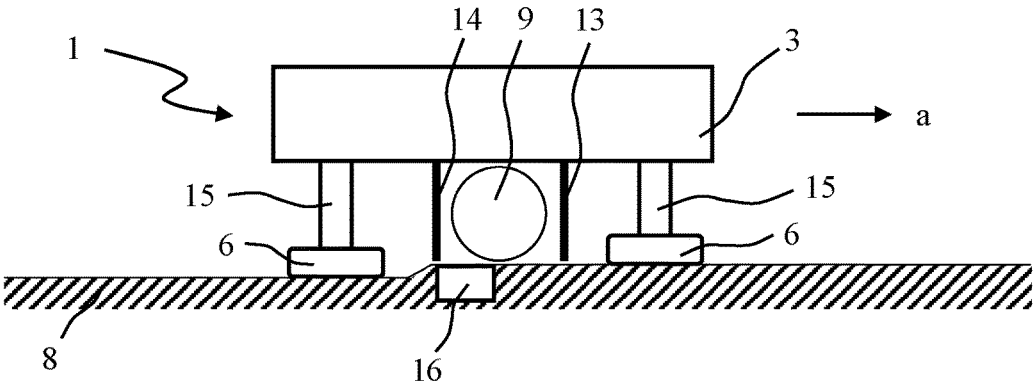
Figure 8:
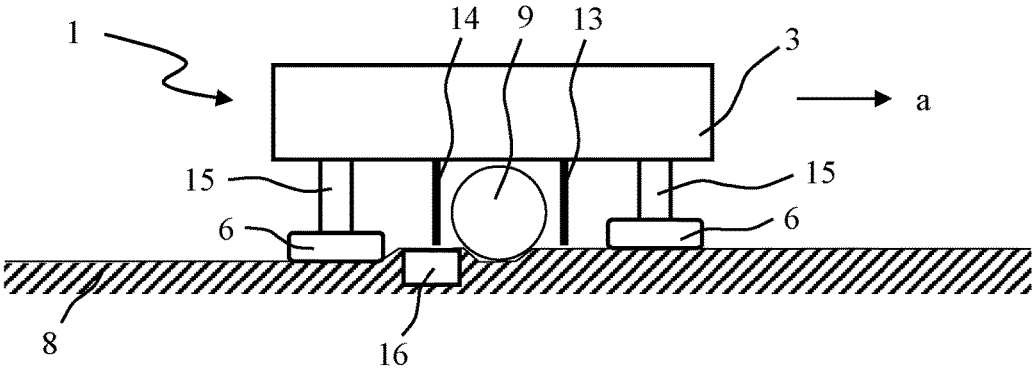
Figure 9:
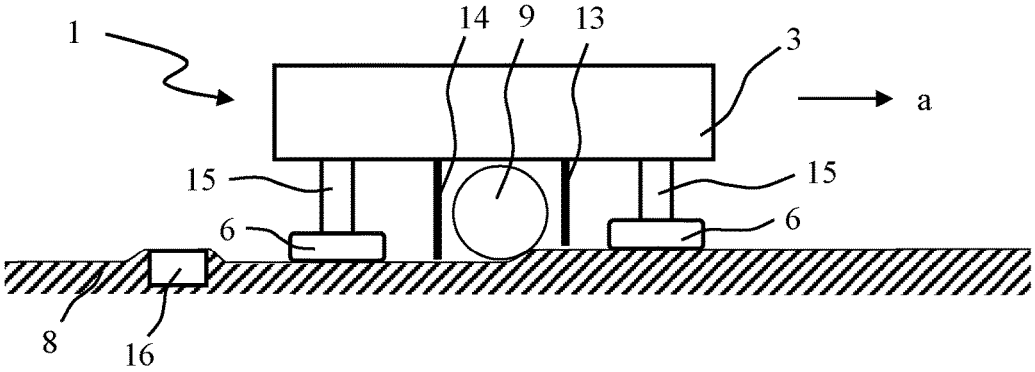

FIGS. 3-9 show the time sequence of milling operations and an obstacle 16 located in the ground 8 to be milled. The obstacle 16 may be, for example, a manhole cover, a manhole or other fixed installation in the ground 8. In particular, the obstacle 16 should not be damaged or destroyed by the milling work. At the same time, the milling drum 9 or its milling tools 11 should also be protected from damage due to a collision with the obstacle 16. FIG. 3 thus shows the situation before the beginning of the milling work. The milling drum 9 is arranged in a raised position above the ground 8. It is then lowered into the ground 8 while rotating and while the road milling machine 1 moves over the ground 8 in the working direction a. The milling drum 9 thus removes the ground 8 and a milling track is created. This situation is shown in FIG. 4. The road milling machine 1 is moved to just in front of the obstacle 16 in the working direction a. FIG. 5 shows the situation in which the road milling machine 1 has been positioned and stopped in front of the obstacle 16. To prevent a collision between the milling drum 9 and the obstacle 16, the milling drum 9 is then raised vertically upwards by at least the specified milling depth of the milling track, as shown in FIG. 6. According to the present invention, the rear blade 14 remains in its working position for the time being and is therefore not moved vertically upwards from the ground 8 at the same time as the milling drum 9. If necessary, the rear blade 14 can be adjusted vertically downwards in relation to the milling drum 9. Next, the road milling machine 1 moves over the obstacle 16 with the milling drum 9 in such a way that the milling drum 9 does not touch the obstacle 16. How exactly the rear blade 14 can be raised out of the milling track in this case is explained in more detail below. The situation of moving over the obstacle 16 with the milling drum 9 raised and the rear blade 14 raised is shown in FIG. 7. FIG. 8, in turn, shows the next work step, in which the milling drum 9 is lowered back into the ground 8 behind the obstacle 16 in the working direction a and mills a new milling track behind the obstacle 16 in the working direction a. This milling work behind the obstacle 16 can then be continued as usual, as shown in FIG. 9. The present invention makes it possible to carry out only minimal finishing work both in front of and behind the obstacle 16 in the working direction a; for example, to remove ground material that has not been milled off or milled material that has been left lying around.

Figure 10:
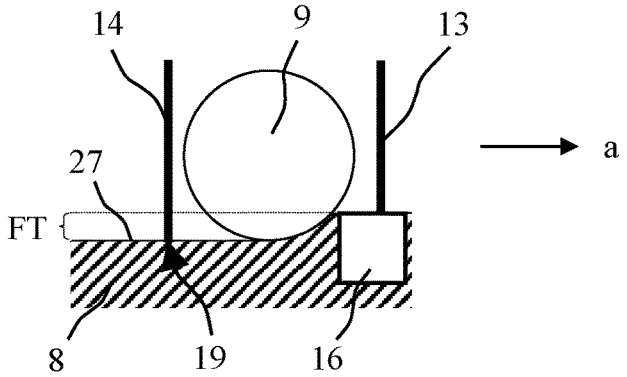
FIG. 10 shows a detailed view according to section X from FIG. 5.
Figure 11:
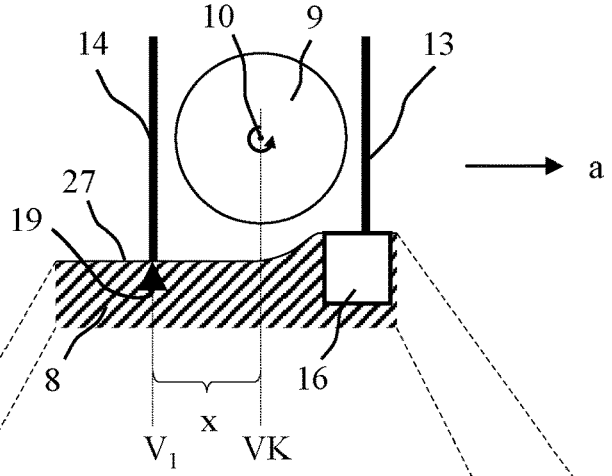
FIG. 11 shows a detailed view according to FIG. 10 with a raised milling drum.

FIG. 10 shows the enlarged section X from FIG. 5. In the time sequence of the milling work, the road milling machine 1 or the milling drum 9 has been positioned just in front of the obstacle 16. Up to the obstacle 16, the milling drum 9 has cleared a milling track at a milling depth FT. As shown in FIG. 11, the milling drum 9 is now raised vertically out of the milling track by at least the milling depth FT. In addition to the milling depth FT, the milling drum 9 can also be raised by a safety distance, for example 2 cm. This ensures that the milling tools 11 of the milling drum 9 do not come into contact with the obstacle 16. As also shown in FIG. 11, the rear blade 14 is still in its working position. In particular, the lower edge 19 of the rear blade 14 is still in contact with the milling bed ground 27. Starting from the situation in FIG. 11, the raising of the rear blade 14 is controlled in such a way that the lower edge 19 of the rear blade 14 follows one of the trajectories T shown in FIGS. 12-18, described in more detail below.

Figure 12:
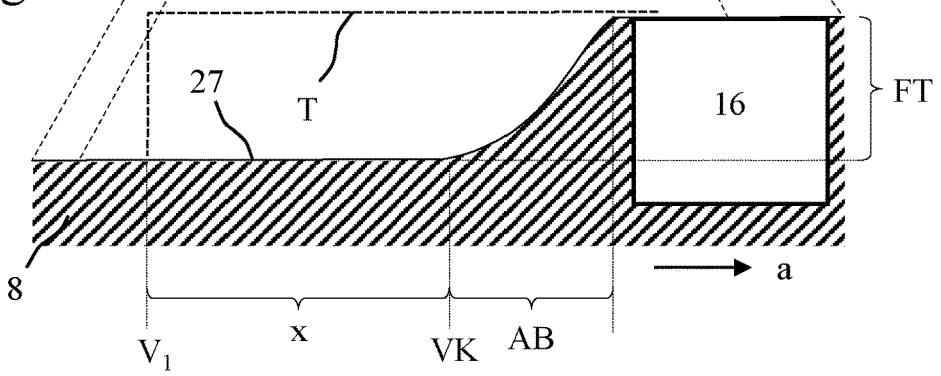
FIG. 12 shows a single-step trajectory.

FIG. 12 shows a case where the rear blade 14 is raised at the same time as the milling drum 19. The raising of the milling drum 9 creates an excavation area AB in front of the obstacle 16 in the working direction a, the shape of which corresponds substantially to the circumference of the milling drum 9 or its cutting circles, and which runs from the milling bed ground 27 to the unmilled ground 8. The line transverse to the working direction a at which the milling depth FT is still at a maximum, but then begins to decrease in the working direction a, is called the front edge VK of the excavation area AB. As can be seen from a comparison of FIGS. 11 and 12, the front edge VK of the excavation area AB lies directly vertically below the axis of rotation 10 of the milling drum 9 at the position where the milling drum 9 is raised out of the milling track. The distance between the axis of rotation 10 of the milling drum 9 and the rear blade 14 in the working direction a is denoted as x. FIG. 12 now shows the case in which the rear blade 14 is lifted out at the same time as the milling drum 9, i.e., the displacement point V1 at which the rear blade 14 is lifted out of the milling track is at a distance x from the front edge VK of the excavation area AB. In addition, the lower edge 19 of the rear blade 14 is guided along a single-step, right-angled trajectory T.

Figure 13:
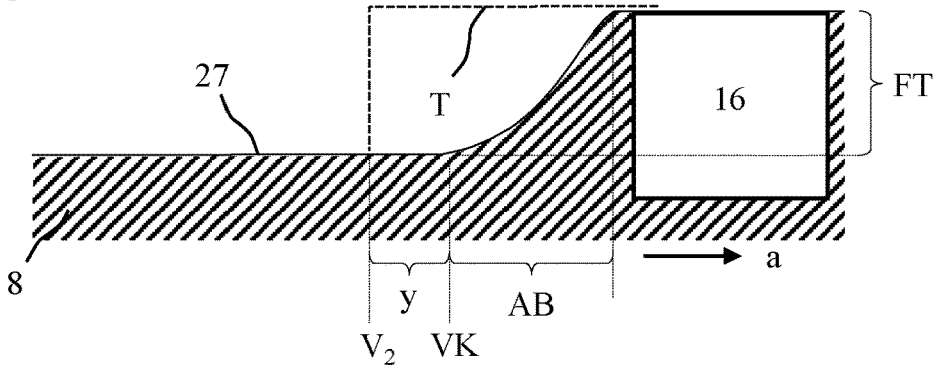
FIG. 13 shows a further single-step trajectory with a displacement point shifted towards the front edge of the excavation area.

FIG. 13 shows a case in which the lower edges 19 of the rear blade 14 are raised out at a displacement point $V_2$, wherein the displacement point $V_2$ is a distance y away from the front edge VK of the excavation area AB, wherein the distance y is smaller than the distance x. For this purpose, it is necessary that the rear blade 14 remains in the working position after the raising of the milling drum 9 and the road milling machine 1 moves further in the working direction a between the raising of the milling drum 9 and the raising of the rear blade 14, specifically by the difference of the distance x minus the distance y. Only after the road milling machine 1 has moved further in the working direction a, by this difference is the rear blade 14 raised out at the displacement point $V_2$. This has the advantage that the rear blade 14 still fulfills its function up to the displacement point $V_2$ and transports the loose milled material accumulated in the milling drum case 17 together with the milling drum case 7. In this way, less milled material remains on the milled bed ground 27 after raising the rear blade 14. Also, in FIG. 13, the lower edge 19 of the rear blade 14 is guided along a single-step, right-angled trajectory T.

Figure 14:
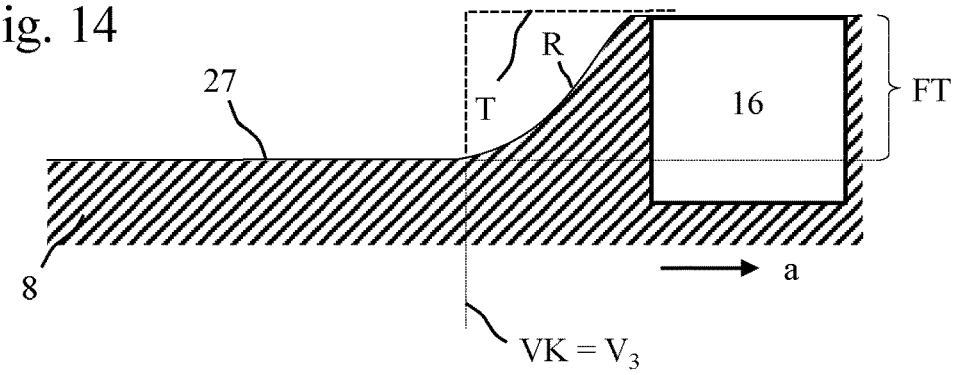
FIG. 14 shows a further single-step trajectory with a displacement point corresponding to the front edge of the excavation area.

FIG. 14 shows a case in which the rear blade 14 is raised out of the milling track at a displacement point $V_3$, wherein the displacement point $V_3$ corresponds to the front edge VK of the excavation area AB. In other words, the distance yin the case of FIG. 14 is zero. Thus, after the milling drum 9 has been raised out of the milling track, the rear blade 14 is kept in working position up to the front edge VK of the excavation area AB and is also only raised out of the milling track at the front edge VK. The rear blade 14 is therefore raised out of the milling track at the same position in the working direction a as the milling drum 9. Since the milling depth FT in the working direction a starts to decrease behind the front edge VK, it is necessary to raise the rear blade 14 at the front edge VK at the latest. The trajectory T along which the lower edge 19 of the rear blade 14 is guided can be adapted in different ways to the geometry of the ramp R in the excavation area AB. The trajectory T shown in FIG. 14 is again single-step and rectangular.

Figure 15:
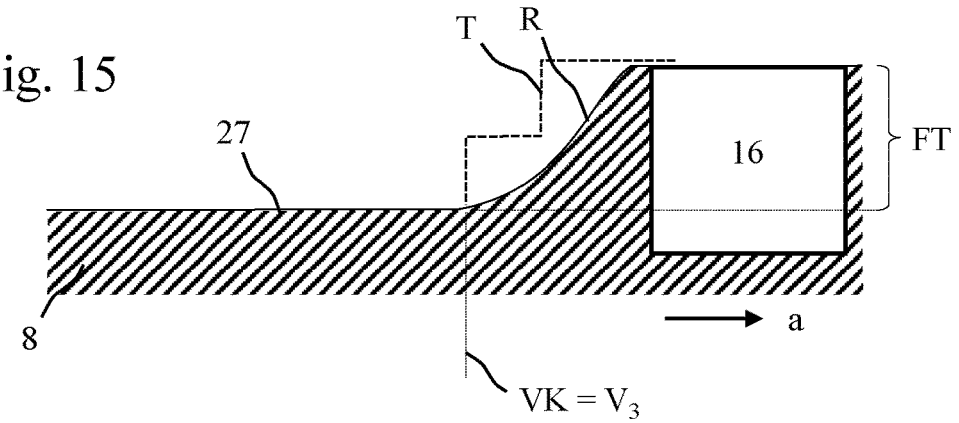
FIG. 15 shows a multi-step trajectory.
Figure 16:
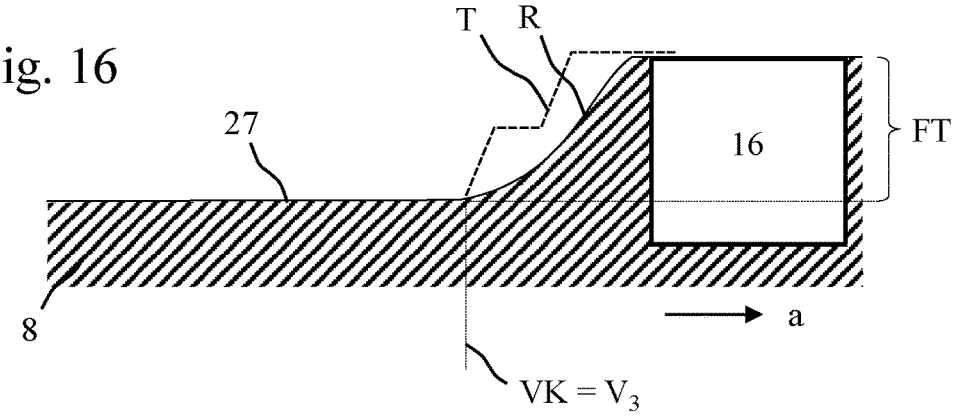
FIG. 16 shows a multi-step trajectory with inclined sections.
Figure 17:
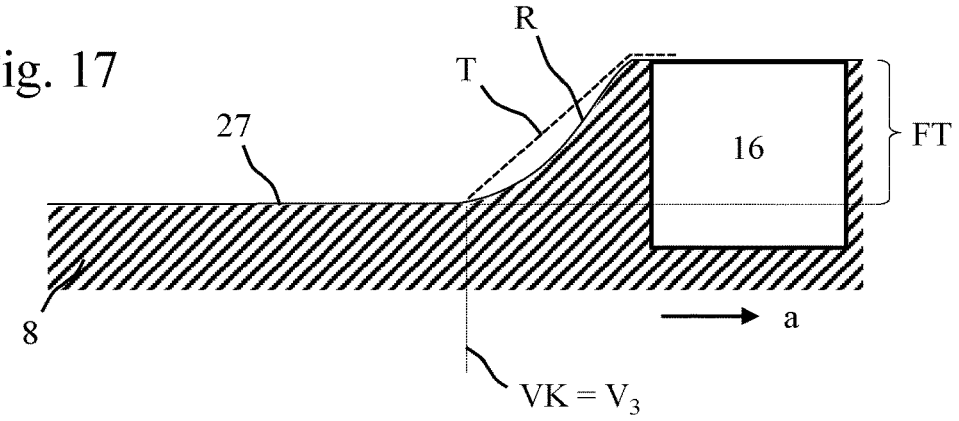
FIG. 17 shows a single-step, inclined trajectory.
Figure 18:
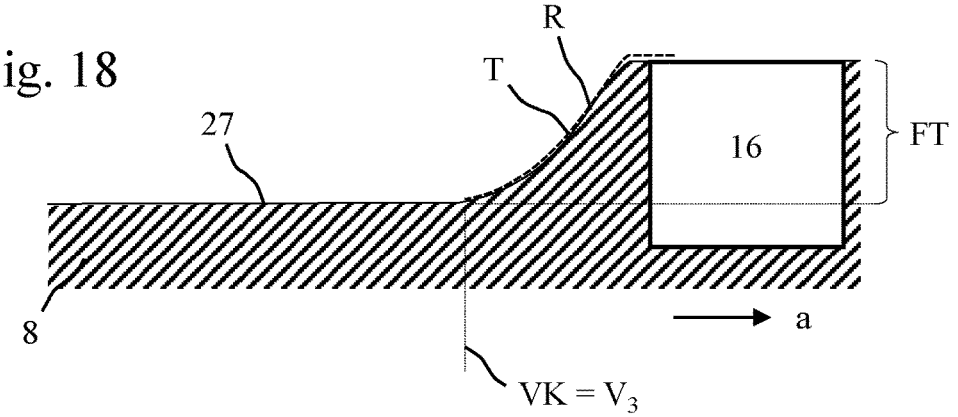
FIG. 18 shows a trajectory in which the lower edge of the rear blade is substantially in contact with the surface of the ramp in the excavation area.

Further examples of differently shaped trajectories T can be seen in FIGS. 15-18. In fact, FIGS. 15-18 only show cases in which the rear blade 14 is raised out at the displacement point $V_3$ corresponding to the front edge VK. However, according to the present invention, cases are also included in which the shapes of the trajectories T of FIGS. 15-18 are used starting from a displacement point $V_2$ at a distance y from the front edge VK of the excavation area AB, and in which the distance y is in particular not zero. For example, FIG. 15 shows a multi-step trajectory T, in this case a two-step trajectory T. Of course, the trajectory T can optionally comprise more steps. Furthermore, in the example shown in FIG. 15, these are right-angled steps, which result from the fact that the vertical height adjustment of the rear blade 14 is carried out free from superimposition with the advancement motion of the road milling machine 1. In other words, the height adjustment of the rear blade 14 is carried out whenever the road milling machine 1 is stationary and does not move in the working direction a. FIG. 16 shows a case in which there is also a multi-step trajectory T, but the individual steps have an obtuse angle. For this purpose, the height adjustment of the rear blade 14 in the vertical direction is superimposed with a movement of the road milling machine 1 in the working direction a, so that an overall trajectory T is produced which is directed inclined forwards and upwards. Again, as in the other exemplary embodiment with a multi-step trajectory T, the height adjustment of the rear blade 14 in the vertical direction is not adjusted in a single movement from the working position through to the raised position, but in an interval-like manner. In particular, between vertical movement sections of the rear blade 14, there are further sections in which the lower edge 19 of the rear blade 14 is moved along with the road milling machine 1 by its advancement only in the working direction a, resulting in the horizontal portions of the trajectory T. FIG. 17 again shows a single-step trajectory T, but this time inclined. The trajectory T according to FIG. 17 thus comprises a single continuous movement of the rear blade 14 in the vertical direction from the working position to the raised position. The vertical adjustment of the rear blade 14 is continuously superimposed by the movement of the road milling machine 1 in the working direction a, so that the inclined movement path results overall. The angle of the inclined trajectory T with respect to a horizontal line, in particular the milling bed ground 27, is selected in such a way that the trajectory T runs from the front edge of the excavation area AB to the end of the excavation area AB opposite the front edge VK in the working direction a. In particular, the angle is selected in such a way that the lower edge 19 of the rear blade 14 abuts the front edge VK and the end of the excavation area AB opposite the front edge VK in the working direction a or hovers above it with a predetermined safety distance. In other words, the trajectory T runs from the front end of the ramp R in the working direction a to the rear end of the ramp R in the working direction a. Finally, FIG. 18 shows a trajectory T with a course adapted to the excavation area AB and the ramp R, respectively. Taking into account the geometry of the milling drum 9 as well as the advancement speed of the road milling machine 1 and, in particular, its acceleration, the lower edge 19 of the rear blade 14 is guided along the trajectory T in such a way that the lower edge 19 follows the surface of the ramp R, either touching it or hovering above it at a predetermined safety distance.

Figure 19:
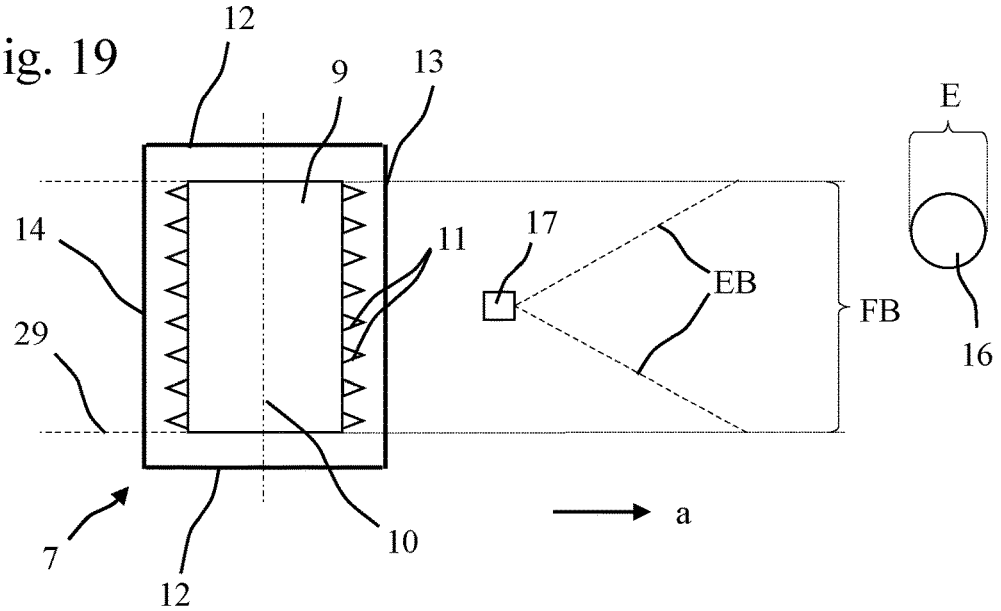
FIG. 19 shows a sensor device with a sensor.
Figure 20:
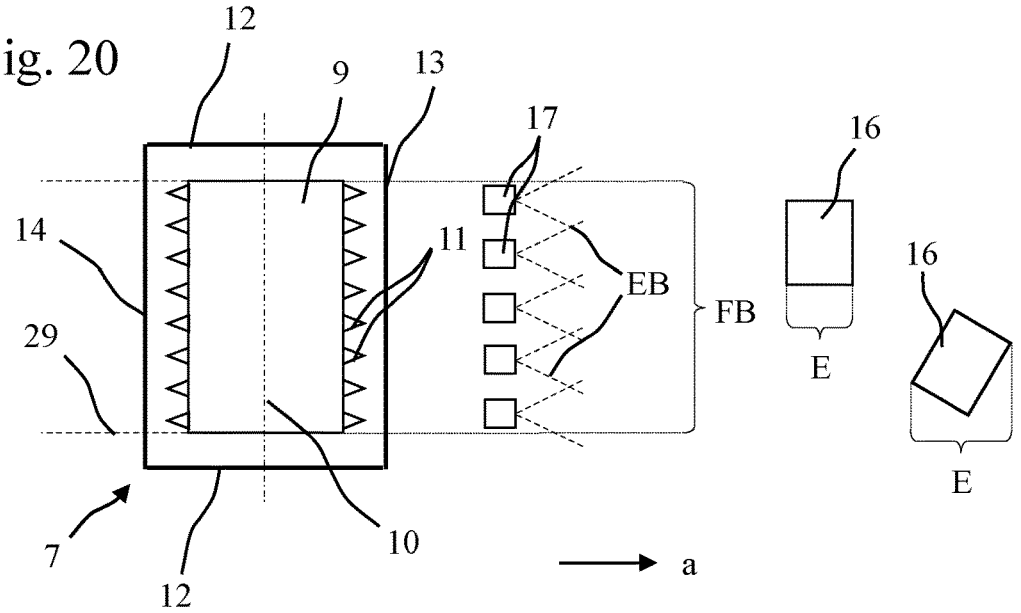
FIG. 20 shows a sensor device with a plurality of sensors.

FIG. 19 shows a top view of the milling drum case 7 as shown in FIG. 2. In operation of the milling drum 9, it mills off the ground 8 in the working direction a, creating the milling track 29. The milling track 29 is created over the entire milling width FB of the milling drum 9. The milling width FB corresponds substantially to the extension of the milling drum 9 along the axis of rotation 10. In the exemplary embodiment shown, a sensor device 17 is arranged in the working direction a in front of the milling drum 9 and also in front of the milling drum case 7, which sensor device is designed to detect obstacles 16 in the ground 8 and in particular within the milling width FB. For this purpose, the sensor device 17 is designed in such a way that it has a detection range EB that covers the entire milling width FB. FIG. 20 shows an embodiment in which the sensor device 17 comprises a plurality of individual sensors. Each of the individual sensors has a detection range EB that is smaller than the milling width FB. Overall, however, the sensor device 17 is again designed in such a way that the entirety of the detection ranges EB of all the sensors of the sensor device 17 cover the entire milling width FB. The sensor device 17 can additionally be designed to detect or determine the extension E of the obstacle 16 in the working direction a. This is shown in FIG. 19, for example, using a round obstacle 16, such as a manhole cover. In FIG. 20, this is shown in the case of non-circular, for example rectangular, obstacles 16, such as installation shafts. The extension E of the obstacle 16 is always related to the working direction a, as can be seen in particular from FIG. 20. It runs from the front edge of the obstacle 16 in the working direction a to the rear edge of the obstacle 16 in the working direction a. If this extension E and thus the edges of the obstacle 16 are taken into account in the control of the road milling machine 1 as described above, it can be efficiently prevented that the milling drum 9 comes into contact with the obstacle 16.

Figure 21:
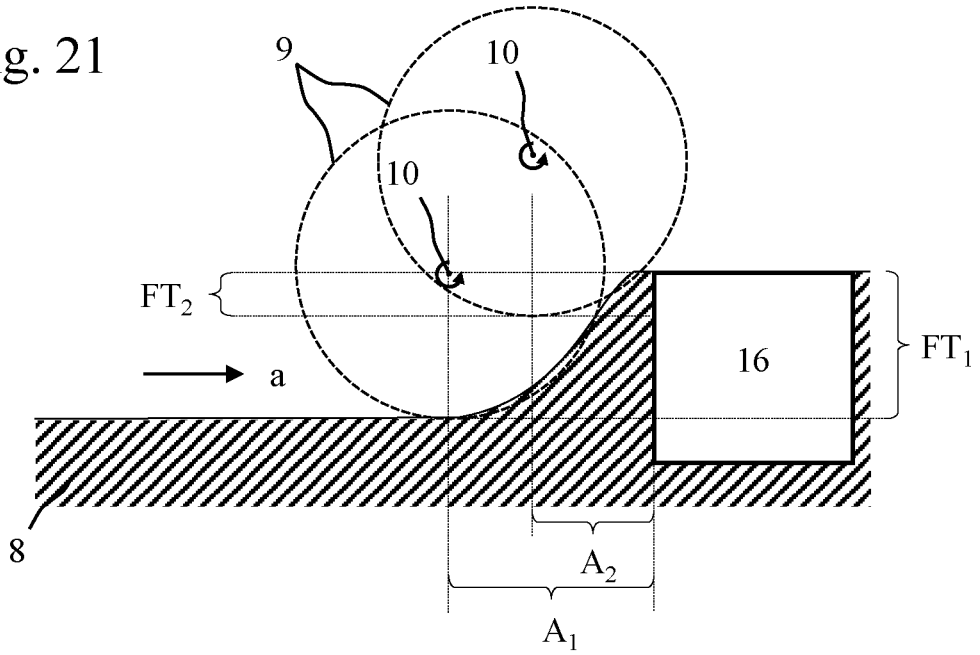
FIG. 21 shows the influence of the milling depth on the position of the raising of the milling drum.

FIG. 21 shows the influence of the milling depth on the position at which the milling drum 9 must be raised out of the milling track 29 to avoid contact between the obstacle 16 and the milling drum 9. In particular, two different positions of milling drums 9 are shown with dashed lines, which milling drums are at different milling depths $FT_1$ and $FT_2$, wherein the milling depth $FT_1$ is greater than the milling depth $FT_2$. The different milling depths $FT_1$, $FT_2$ result in different distances $A_1$, $A_2$ between the respective axis of rotation 10 of the milling drums 9 and the obstacle 16, in which the milling drum 9 must be raised out of the milling track 29. In particular, the milling drum 9 can be raised out of the milling track 29 at a smaller distance $A_2$ in front of the obstacle 16 at a lower milling depth $FT_2$ than at a higher milling depth $FT_1$. The road milling machine 1 can therefore move closer to the obstacle 16 at a lower milling depth FT than at a higher milling depth FT. This parameter, together with the geometry of the milling drum 9, is therefore taken into account by the control device 18 when it automatically determines the position for raising the milling drum 9.

Figure 22:
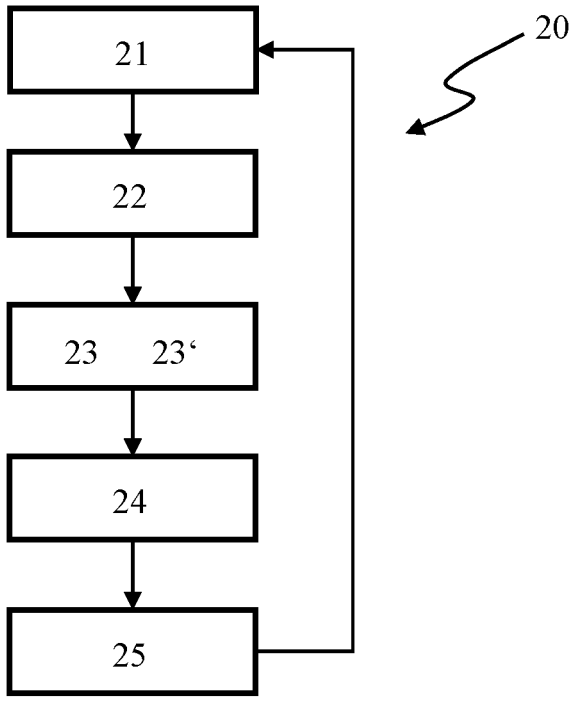
FIG. 22 shows a flow diagram of the method.

FIG. 22 shows a flow diagram of the method 20 for controlling the road milling machine 1 when there is an obstacle 16 located in the ground 8 to be milled. The method 20 starts with the milling 21 of the ground 8 at a predetermined milling depth FT in the working direction a during the completely normal operation of the road milling machine 1. This is followed by advancing 22 the road milling machine 1 towards the obstacle 16 located in the ground 8. This can either be carried out by the operator or, for example, can also be carried out automatically by the control device 18, in particular if a sensor device 17 is provided which can detect the obstacle 16 located in the ground 8. The road milling machine 1 is positioned in front of the obstacle 16. Next, the raising 23 of the milling drum 9 and the rear blade 14 out of the ground 8 takes place in front of the obstacle 16. Here, according to the present invention, it is provided that the raising 23 of the milling drum 9 is carried out before the raising 23' of the rear blade 14 out of the ground 8, and that the road milling machine 1 continues to move in the working direction a between the raising 23 of the milling drum 9 and the raising 23 of the rear blade 14. This shortens the distance y between the front edge VK of the excavation area AB and the displacement point $V_{2/3}$ of the rear blade 14. Subsequently, the obstacle 16 is moved over 24, wherein the milling drum 9 remains out of contact with the obstacle 16. Finally, lowering 25 of the milling drum 9 and the rear blade 14 to the predetermined milling depth FT in the working direction a takes place behind the obstacle 16, such that the milling process can be continued. The raising 23, 23', moving over 24 and lowering 25 can all be carried out automatically by the control device 18. For example, this can be triggered by a single control command from the operator or, alternatively, also by the detection of the obstacle 16 by the sensor device 17. The method 20 described herein relieves the operator of the road milling machine of repetitive control operations when there are obstacles 16 during operation. At the same time, less milled material is left in the milling bed, such that the finishing work required is reduced by the method 20 according to the present invention. Therefore, overall, the milling process of the road milling machine 1 can be made more economical and efficient.

What is claimed is:

1. A method for controlling a road milling machine for milling a ground comprising a milling drum and a rear blade, the method comprising, when there is an obstacle located in the ground to be milled, the steps of:

a) milling the ground at a predetermined milling depth (FT) along a working direction (a);

b) advancing the road milling machine in the working direction (a) towards the obstacle located in the ground;

c) raising the milling drum and the rear blade out of the ground in the working direction (a) in front of the obstacle;

d) moving over the obstacle in such a way that the milling drum remains out of contact with the obstacle; and e) lowering the milling drum and the rear blade to the predetermined milling depth (FT) in the working direction (a) behind the obstacle and continuing the milling of the ground, wherein the road milling machine is controlled in such a way that in step c) the raising of the milling drum is carried out before the raising of the rear blade out of the ground, wherein the road milling machine continues to move in the working direction (a) between the raising of the milling drum and the raising of the rear blade, and wherein, when raising the milling drum, the height of the rear blade is adjusted to below a lower apex of the milling drum by at least 10% of a diameter of the milling drum.

2. The method according to claim 1, wherein the raising of the milling drum leaves an excavation area (AB) in which the milling depth (FT) of the milled track begins to decrease in the working direction (a) as a result of the raising of the milling drum, wherein the excavation area (AB) has a front edge (VK) at its deepest point, wherein the raising of the rear blade takes place at a displacement point ($V_2$) along the working direction (a) which is at a distance (y) from the front edge (VK) of the excavation area (AB) which is smaller than a distance (x) of the rear blade from an axis of rotation of the milling drum, or the raising of the rear blade takes place at a displacement point ($V_3$) along the working direction (a) which is on the front edge (VK).

3. The method according to claim 1, wherein the raising of the rear blade is controlled in such a way that a lower edge of the rear blade facing the ground follows a predetermined trajectory (T) during the raising, taking into account the advancement speed and the acceleration of the road milling machine.

4. The method according to claim 3, wherein the trajectory (T) has at least one of the following features:

the trajectory (T) comprises exclusively one movement transverse to the working direction (a) vertically upwards, which is not superimposed with a traveling movement of the road milling machine in the working direction (a), and a subsequent movement horizontally in the working direction (a);

the trajectory (T) comprises a plurality of step-wise movements transverse to the working direction (a) vertically upwards, wherein the lower edge is moved horizontally in the working direction (a) between the steps, and wherein the step-wise vertical movements are not superimposed with a traveling movement of the road milling machine in the working direction (a);

the trajectory (T) comprises at least one tilted movement, simultaneously transverse to the working direction (a) vertically upwards and horizontally in the working direction (a); and the trajectory (T) follows a ramp (R) in the excavation area (AB) created by the raising of the milling drum in such a way that the lower edge substantially abuts the surface of the ramp (R) over the entire excavation area (AB).

5. The method according to claim 3, wherein the lowering of the rear blade to the predetermined milling depth (FT) in the working direction (a) behind the obstacle is controlled in such a way that the lower edge of the rear blade follows the same trajectory (T) as followed during the lowering as during the raising, in the opposite direction.

6. The method according to claim 1, wherein at least one sensor device is arranged in front of the milling drum in the working direction (a), which sensor device is designed to detect obstacles in the ground to be milled, wherein the at least one sensor device comprises an inductive, capacitive, or magnetic sensor, an optical sensor, or a sound sensor.

7. The method according to claim 6, wherein the operator is shown a representation of the obstacle on a display device produced from data obtained from a sensor device, and in that the operator can specify on the display device the front and rear edges of the obstacle in the working direction (a), wherein steps c), d), and e), are then carried out in such a way that the milling drum remains out of contact with the edges of the obstacle specified by the operator.

8. The method according to claim 6, wherein a position in the working direction (a) at which the raising of the milling drum is carried out is determined taking into account a position of the obstacle, the milling depth (FT) and also the geometry of the milling drum in order to keep the milling drum out of contact with the obstacle.

9. The method according to claim 6, wherein the magnetic sensor comprises a metal detector.

10. The method according to claim 6, wherein the optical sensor comprises a camera or a thermal imaging camera.

11. The method according to claim 6, wherein the sound sensor comprises an ultrasonic sensor.

12. The method according to claim 1, wherein in order to carry out steps c), d), and e), an extension (E) of the obstacle in the working direction (a) is input in advance by the operator, or in that the extension (E) of the obstacle in the working direction (a) is determined by a sensor device.

13. The method according to claim 1, wherein steps c), d), and e), are carried out automatically, triggered by a single control command from an operator or by the detection of an obstacle by a sensor device.

14. The method according to claim 1, wherein during steps c) and d), a conveyor device of the road milling machine is put out of operation automatically.

15. The method according to claim 1, wherein to continue the milling of the ground according to step e), machine settings with regard to milling depth (FT) and/or advancement speed and/or operation of the conveyor device are automatically set as machine settings set in step a).

16. A road milling machine for milling a ground in a working direction (a), comprising:

a machine frame supported by travel devices;

a milling drum case mounted on the machine frame having a front blade, two side blades and a rear blade which is height-adjustable relative to the machine frame;

a milling drum mounted rotatably about an axis of rotation in the milling drum case; and a control device, wherein the control device is designed to carry out the method according to claim 1, and wherein the road milling machine has an adjusting device for adjusting the height of the rear blade, which is designed in such a way that the rear blade is adjustable to below a lower apex of the milling drum by at least 10% of the diameter of the milling drum.

17. The road milling machine according to claim 16, wherein the road milling machine has an adjusting device for adjusting the height of the rear blade, which is designed in such a way that the rear blade is adjustable to below a lower apex of the milling drum by at least 20% of the diameter of the milling drum.

18. The road milling machine according to claim 16, wherein the road milling machine has an adjusting device for adjusting the height of the rear blade, which is designed in such a way that the rear blade is adjustable to below a lower apex of the milling drum by at least 30% of the diameter of the milling drum.

* * * * *